United States Patent [19]

Yamana

[11] 4,398,882

[45] Aug. 16, 1983

[54] COMBUSTION SAFETY APPARATUS

[75] Inventor: Toshifumi Yamana, Kasugai, Japan

[73] Assignee: Rinnai Kabushiki Kaisha, Nagoya, Japan

[21] Appl. No.: 181,226

[22] Filed: Aug. 25, 1980

[30] Foreign Application Priority Data

Sep. 1, 1979 [JP] Japan ..... 54-112262

[51] Int. Cl.[3] ..... F23N 5/24

[52] U.S. Cl. ..... 431/76; 431/80

[58] Field of Search ..... 431/75, 76, 78, 80, 431/50

[56] References Cited

U.S. PATENT DOCUMENTS 4,125,356 11/1978 Ohashi et al. .
4,140,475 2/1979 Wolfe ..... 431/76 X

FOREIGN PATENT DOCUMENTS 54-113537 9/1979 Japan .
54-125541 9/1979 Japan ..... 431/76
54-158733 12/1979 Japan ..... 431/76
54-158734 12/1979 Japan ..... 431/76
54-159745 12/1979 Japan ..... 431/76
55-96832 7/1980 Japan ..... 431/76

*Primary Examiner*—Samuel Scott
*Assistant Examiner*—Margaret A. Focarino
*Attorney, Agent, or Firm*—Armstrong, Nikaido, Marmelstein & Kubovcik

[57] ABSTRACT

There is provided a combustion safety apparatus where the main burner has a combustion detecting element such as an oxygen concentration cell element, and the element is arranged so that one electrode thereof is always heated by a flame of a standing burner and into an oxygen lack condition while the other electrode is heated by the main burner. When the main burner is in its complete combustion condition, there is a difference in oxygen concentration between the two electrodes and thereby there is generated an output at the element. On the other hand, when the main burner is in its incomplete combustion condition, the difference in oxygen concentration therebetween is decreased and thereby the output is lowered. In addition there is provided a safety device such as a gas safety valve or the like. The same is arranged to be controlled in operation by the output directly or indirectly; the element is formed into a long plate disposed to extend along nearly at a right angle to the direction of the flame of the standing burner.

4 Claims, 9 Drawing Figures

COMBUSTION SAFETY APPARATUS

BACKGROUND OF THE INVENTION

The present invention relates to a combustion safety apparatus used chiefly for gas appliances.

As for an apparatus of this kind, there has been hitherto proposed in the prior art a type as that shown in FIGS. 1 to 3, for instance, having a combustion detecting element b such as an oxygen concentration cell element or the like which is provided in front of a main burner a, and the element b is so arranged that one electrode thereof is always so heated by a flame of a standing burner c as to be brought in a lack of oxygen condition, while the other electrode thereof is heated by the main burner a, so that when the main burner a is in its complete combustion condition, a flame d thereof is apart from the element b as shown by a solid line in FIG. 2 and thereby a difference in oxygen concentration is formed between the two electrodes and thereby a comparatively large output at the element b is generated, and, on the other hand, when the main burner a is in incomplete combustion condition, the flame d is so elongated as to reach the element b as shown by dotted lines in the same Figure and thereby the difference in oxygen concentration therebetween is decreased and the output is lowered. In addition, there is provided a safety device e such as a gas safety valve or the like, and the same is arranged to be controlled in operation directly or indirectly by the foregoing output of the element b.

It has been usual with this type of prior art apparatus, that the element b is formed into a long rectangular plate and is disposed to extend substantially in the same direction with the flame f of the standing burner c as illustrated. With this arrangement, however, there is involved disadvantages whereby—in the case where the element b is heated by the flame f which acts on the forward end portion of the element b as shown in FIG. 4, the flame f tends to go more or less off or beyond the forward end of the element b toward the front surface of the main burner a, and consequently the main burner a is partially influenced thereby and a back-fire is brought about at that portion. Furthermore, when the main burner a is brought in its incomplete combustion condition and consequently the flame d is elongated, the flame d is pushed back to retreat from the element b, by the flame f of the standing burner c, and thereby the detecting operation of the element b is spoiled.

Accordingly, such a preventive measure can be considered that the flame f of the burner c is so previously set as not to go beyond the forward end of the element b as shown in FIG. 6. In this measure, however, the heated area of the element b by the flame f becomes comparatively large and consequently the difference in oxygen concentration, that is, the output of the element b is increased that there is caused such an inconvenience that the difference cannot be sufficiently negated by the flame developed in the incomplete combustion condition.

SUMMARY OF THE INVENTION

This invention has for its main object an apparatus free from these prior art defects.

According to the invention, an apparatus is provided of the type in which a main burner is provided in front of the same with a combustion detecting element such as an oxygen concentration cell element or the like. The element is so arranged that one electrode thereof is always heated by a flame of a standing burner so as to be brought in an oxygen lack condition, while the other electrode thereof is heated by the main burner, so that when the main burner is in its complete combustion condition there is made a difference in oxygen concentration between gas atmospheres adjacent to the two electrodes thereby generating an output at the element, and, on the other hand, when the main burner is in its incomplete combustion condition, the difference in the oxygen concentration therebetween is decreased and thereby the output is lowered. In addition, there is provided a safety device such as a gas safety valve or the like where the safety device is arranged to be controlled in operation by the output directly or indirectly and wherein: the element is formed into a long plate and is disposed to extend along nearly at right angle to the direction of the flame of the standing burner.

One embodying example of this invention will now be explained with reference to the accompanying drawings:

IN THE DRAWINGS

DESCRIPTION OF THE INVENTION

Figure 7:
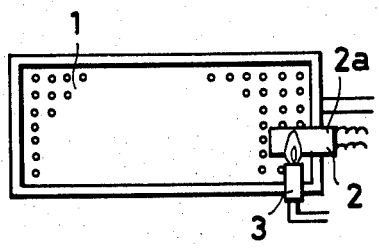
FIG. 7 is a front view of one exemplified apparatus of this invention.
Figure 8:
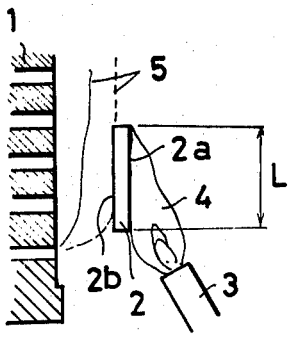
FIG. 8 is an enlarged sectional side view of a portion thereof.
Figure 9:
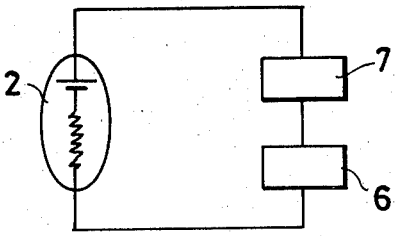
FIG. 9 is an electric circuit diagram thereof.

Referring to FIGS. 7 to 9 showing this example, a combustion detecting element 2 such as an oxygen concentration cell element or the like which is provided in front of the main burner 1. This element 2 is preferably an oxygen concentration cell element comprising an element main body of zirconia having on its both surfaces porous electrodes 2*a*, 2*b* of platinum. The element 2 is so arranged that the electrode 2*a* on one side thereof, is always heated by a flame 4 of a standing burner 3 so as to be brought in an oxygen lack condition, while the electrode 2*b* on the other side thereof is heated by the main burner 1. Thus, when the main burner 1 is in its complete combustion condition, a flame 5 thereof is apart from the element 2 as shown by a solid line in FIG. 8 and thereby there is made a difference in oxygen concentration between the two electrodes 2*a*, 2*b* there is generated a comparatively large electric output at the element 1. On the other hand, when the burner 1 is in its incomplete combustion condition, the flame 5 becomes so long, as shown by dotted lines in the same Figure, as to be brought into contact with the element 2, and thereby the difference in oxygen concentration is so lost that the output of the element 2 is much lowered. Additionally, the element 2 is connected at its output side to a safety device 6 such as a gas safety valve or the like, directly or through a control circuit 7 as shown in FIG. 9, so that the safety device 6 is controlled in operation by the output of the element 2 directly or indirectly.

The above construction is not especially different from that in the previously proposed one as mentioned above. According to this invention, the element 2 is formed into a long plate one and is disposed to extend long substantially at right angle to the flame 4 of the standing burner 3. Thus, the electrode 2*a* on one side of the element 2 is acted on by the flame 4 of the standing burner 3, and the acted area thereof, that is, the heated area thereof, can become a predetermined one by such a way that the vertical directional length L, as shown in FIG. 8, of the electrode 2*a*, that is, the width L of the element 2, is previously set to a desired one, and consequently it becomes possible that the same may be brought in a balanced condition with the flame 5 acting on the other electrode 2*b*.

Figure 1:
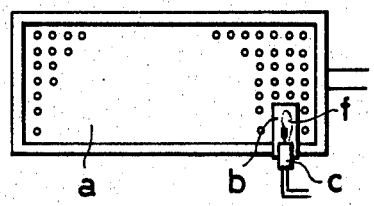
FIG. 1 (PRIOR ART)
FIG. 1 is a front view of a conventional apparatus.
Figure 2:
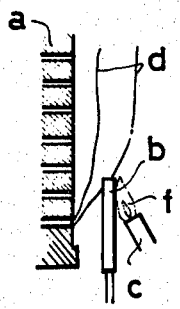
FIG. 2 (PRIOR ART)
FIG. 2 is an enlarged sectional side view of a portion thereof.
Figure 3:
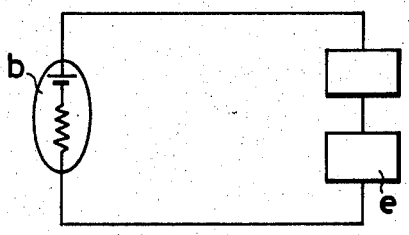
FIG. 3 (PRIOR ART)
FIG. 3 is an electric circuit diagram thereof.
Figure 4:
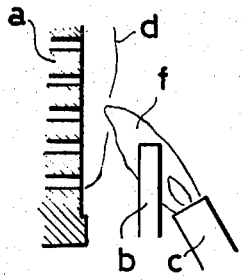
FIG. 4 (PRIOR ART)
FIGS. 4 to 6 are diagrams for explaining operations thereof.
Figure 5:
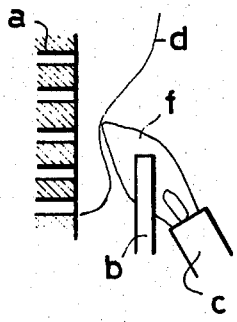
FIG. 5 (PRIOR ART)
Figure 6:
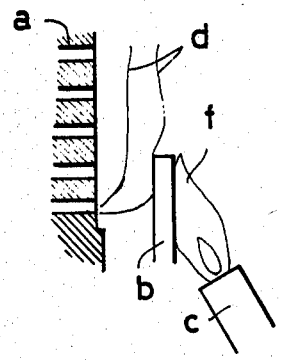
FIG. 6 (PRIOR ART)

In the case of the conventional apparatus, such a modified arrangement can be considered that, as shown in FIG. 6, the vertical length of the element b be shortened to a desired proper one, but for achieving this arrangement it is necessary to use a supporting member extending long downwards from the element b and connection between the two becomes troublesome and additionally the element b is liable to be deformed or crushed due to such a difference in thermal expansion between the element and the member that is caused by the different materials thereof.

Thus, according to the invention, the combustion detecting element is formed into a long plate one and is so disposed as to be nearly at a right angle to the flame of the standing burner, so that there can be eliminated the foregoing inconveniences in the conventional apparatus wherein the element is disposed in the same direction as the flame.

BEST MODE OF INVENTION

There is provided a combustion safety apparatus where the main burner 1 has a combustion detecting element 2 such as an oxygen concentration cell element, and the element 2 is arranged that one electrode 2*a* thereof is always heated by a flame 4 of a standing burner 3 and into an oxygen lack condition while the other electrode 2*b* is heated by the main burner 1. When the main burner 1 is in its complete combustion condition, there is a difference in oxygen concentration between the two electrodes 2*a*, 2*b* and thereby there is generated an output at the element 2. On the other hand, when the main burner 1 is in its incomplete combustion condition, the difference in oxygen concentration therebetween is decreased and thereby the output is lowered. In addition there is provided a safety device 6 such as a gas safety valve or the like. The same is arranged to be controlled in operation by the output directly or indirectly; the element 2 is formed into a long plate disposed to extend long nearly at a right angle to the direction of the flame 4 of the standing burner 1.

Many modifications and variations of the present invention are possible in light of the above teachings. It is, therefore, to be understood that within the scope of the appended claims, the invention may be practiced otherwise than as particularly described.

What is claimed is:

1. A combustion safety apparatus of the type having a main burner in front thereof, with a combustion detecting element such as an oxygen concentration cell element or the like, the element having a first and second electrode, the first electrode thereof is always heated by a flame of a standing burner and is brought into lack of oxygen condition while the second electrode thereof is heated by the main burner, so that when the main burner is in its complete combustion condition, a difference in oxygen concentration between the two electrodes is formed to generate an output at the element; the main burner in its incomplete combustion condition has a decrease in oxygen concentration difference between the two electrodes and thereby the output at the element is lowered, and a safety device such as a gas safety valve or the like, arranged to be controlled in operation by the output of the element whereby: the element is formed into a long plate having a longitudinal axis, said plate being positioned such that said axis is disposed to extend nearly at a right angle to a center axis of the flame of the standing burner, said center axis being the longitudinal axis of the flame.

2. A combustion safety apparatus as claimed in claim 1, wherein: the element is an oxygen concentration cell element comprising an element main body of zirconia and porous electrodes of platinum on both surface of the element main body.

3. A combustion safety apparatus as claimed in claim 1, wherein: the center axis of the flame of the standing burner extends substantially vertically and inclines to a small degree towards the element and the longitudinal axis of the element extends horizontally.

4. A combustion safety apparatus as claimed in claim 1, wherein: the standing burner is a standing pilot burner.

* * * * *